US007757449B2

(12) United States Patent
Portoles Ibañez et al.

(10) Patent No.: US 7,757,449 B2
(45) Date of Patent: Jul. 20, 2010

(54) REMOVABLE FLOOR

(75) Inventors: Javier Portoles Ibañez, Benicassim (ES); Carlos Sanchis Ballester, Benicassim (ES); Carlos Soler Aguilar, Castellon (ES); Mónica Alegre Olmos, Valencia (ES); Joaquín Peña Villanueba, Valencia (ES); Antonio Carbonell Balaguer, Valencia (ES); José Emilio Gil Serrano, Chiva (ES)

(73) Assignees: Taulell S.A., Castellon de la Plana (ES); Industrias Alegre, S.A., Albal (Valencia) (ES)

( * ) Notice: Subject to any disclaimer, the term of this patent is extended or adjusted under 35 U.S.C. 154(b) by 67 days.

(21) Appl. No.: 11/883,812

(22) PCT Filed: Feb. 7, 2006

(86) PCT No.: PCT/ES2006/000050

§ 371 (c)(1),
(2), (4) Date: Jan. 15, 2008

(87) PCT Pub. No.: WO2006/084932

PCT Pub. Date: Aug. 17, 2006

(65) Prior Publication Data

US 2008/0313987 A1 Dec. 25, 2008

(30) Foreign Application Priority Data

Feb. 7, 2005 (ES) ..... 200500240

(51) Int. Cl.
*E04B 5/00* (2006.01)

(52) U.S. Cl. ..... 52/384; 52/386; 52/387; 52/390; 52/392; 52/177; 52/506.01; 52/592.1; 404/35; 404/41

(58) Field of Classification Search ..... 52/384–392, 52/177, 71, 747.11, 506.01, 592.1, 181; 404/35, 404/41, 47; 15/215
See application file for complete search history.

(56) References Cited

U.S. PATENT DOCUMENTS

| | | | | |
|---|---|---|---|---|
| 3,614,915 | A * | 10/1971 | Perry | 404/40 |
| 5,082,712 | A | 1/1992 | Starp | |
| 6,751,912 | B2 * | 6/2004 | Stegner et al. | 52/177 |
| 6,802,159 | B1 * | 10/2004 | Kotler | 52/177 |
| 6,823,638 | B2 * | 11/2004 | Stanchfield | 52/588.1 |
| 2004/0237420 | A1 * | 12/2004 | Zhang | 52/79.1 |
| 2007/0289236 | A1 * | 12/2007 | Choi | 52/311.2 |

FOREIGN PATENT DOCUMENTS

| | | |
|---|---|---|
| DE | 102 53 553 | 10/2003 |
| JP | 8-135150 | 5/1996 |
| JP | 11 107497 | 4/1999 |
| WO | 03/040491 | 5/2003 |

* cited by examiner

*Primary Examiner*—Jeanette Chapman
(74) *Attorney, Agent, or Firm*—Wenderoth, Lind & Ponack, L.L.P.

(57) ABSTRACT

A removable floor includes a support piece (1) having a floor tile (15) affixed to the upper surface thereof, with the support piece being equipped to be secured to other support pieces, in order to facilitate the installation and removal of the floor by the user and to enable the supports to be installed in an aligned and/or out of phase manner such as to produce different decorative patterns.

28 Claims, 6 Drawing Sheets

REMOVABLE FLOOR

OBJECT OF THE INVENTION

The invention relates to a new removable floor comprising a support of variable dimensions and formats on which a floor tile is glued, said floor tile can be made of any suitable material such as marble, granite, ceramic, wood, etc., and in which said support is provided with joints in order to produce the attachment between different supports, and consequently cover a surface with the floor tiles. Its aim is to provide the possibility of modifying the ergonomic properties of the floor at will, facilitating the laying, removing, replacement, maintenance or exchange of floors, as well as permitting the laying of supports out of phase and/or aligned in order to achieve different decorative motifs.

Another aim is to permit the passage of cables and pipes underneath the support.

PRIOR ART OF THE INVENTION

In the state of the art, the laying of flooring by means of masonry work, requiring the gluing of the floor tiles and coating, over the surface to be covered, with different adhesives, generally in the presence of water, is known, which means that users cannot make any redecorations, replacements or changes of floors and walls with the frequency and will they might wish.

In order to solve this problem, the use of removable floors is known in the state of the art, which comprises a support on which the floor tile is glued, having the support means of joint in order to produce the attachment of the different supports and consequently the laying of the floor tiles, which considerably facilitates the laying/removing of them by the user, permitting permanent and even seasonal use of the floor tiles, this is, during different times of the year and which above all eliminates the earlier mentioned traditional methods of laying.

In this regard, international application WO 03/040491 can be cited in which a removable floor is described consisting of a support with supports manufactured in plastic on which a floor tile or decorative surface is adhered, with two abuting lateral faces of the support having separate upper longitudinal extensions and separate lower longitudinal extensions, among them a curved recess forming a housing is defined; while the other two abuting lateral faces of the support include each other middle longitudinal extensions that are introduced into the housing defining a joint. This configuration presents the drawback that the joint is not optimised, which means that the floor is not ergonomically optimum and could be improved. Moreover, according to one embodiment, the housing is defined by an approximately circular orifice in which fits a complementary curved thickening provided in the middle extension which requires considerable pressure in order to fit the different supports together.

DESCRIPTION OF THE INVENTION

In order to solve the drawbacks and achieve the objectives stated above, the invention has developed a new removable floor, which, as well as those contained in the state of the art, comprises a support piece on which a floor tile of any suitable material, is glued, being said material such as marble, granite, ceramic, etc., all this in such a way that the support piece includes means of securing in order to create the joint between the different supports, and consequently cover the surfaces by means of the floor tiles which are glued to the supports; said means of securing in two abuting lateral faces of the support consisting of separate upper longitudinal extensions and separate lower longitudinal extensions in such a way that they both define a housing; and in the other two abuting lateral faces of the support piece is made for the means of securing to consist in separate middle longitudinal extensions that are introduced into the housing in order to lay the floor.

The present invention is characterised in that the middle longitudinal extensions include a thickening at their end defined by a body with a curved shape which is joined to the middle zone of the side walls of the support by means of a set of equidistant sections; having made the provision for the lower extensions to consist in at least two flanges of width less than or equal to that of the upper longitudinal extensions; and which are provided with a curved longitudinal recess; and in that the lower face of the upper longitudinal extensions include a curved longitudinal recess facing the curved longitudinal recess of the lower extensions, in order to define the housing of the curved body of the middle longitudinal extensions. Moreover, the lower faces of the upper longitudinal extensions include a longitudinal bevel in their front end in order to facilitate the introduction of the curved body. The invention is also characterised in that the floor tiles are glued in a position selected among one in which the two lesser abuting sides of those floor tiles are coplanar with the corresponding lesser sides of the support, and the other two opposite sides of the floor tiles remain out of phase with respect to the corresponding sides of the support in order to define a joint between the floor tiles when they are being laid, the width of which depends on that phase difference, or a position in which the floor tiles are head joined depending on the manufacturing dimension of the floor tiles.

In one embodiment of the invention provision is made for the upper longitudinal extensions to include openings by way of windows in the zones facing the flanges.

The lower face of the support pieces comprises a set of retention fittings consisting on removable stoppers for support of the supports. The use of these stoppers is optional because the fittings can, if wished, serve to secure the supports to the substrate by means of screws, suction pads or similar securing elements.

Moreover, one embodiment of the invention provides for the lower face of the support pieces to include lateral and/or diagonal ribs for acting as a support for the support pieces in the event that the removable stoppers are not used. These ribs can present projections in order to hinder the slipping of the pieces in the event of their laying on a flexible substrate.

The fitting in which the removable stoppers are held back is, according to another embodiment of the invention, made in certain projections which cause the rising up of the support piece in order to allow pipes and cables to pass beneath those support pieces.

Complementary or alternatively to these elevation projections, the lower face of the support pieces is provided with some elevation partitions for allowing pipes and cables to pass beneath the support pieces.

In the preferred embodiment of the invention, the lower extensions of the support pieces are defined by a set of equidistant flanges in which the thickening defined by the curved shape body fits under pressure.

Furthermore, in the preferred embodiment of the invention provision is made for the support piece to consist of a grille including the different elements described above.

In the event that the floor tiles are arranged separately defining a joint, said joint is filled using any conventional method.

The configuration described permits the grilles to be arranged aligned and/or out of phase with respect to others in order to achieve different decorative motifs, such as a herringbone pattern for example.

In addition, the inventive floor has the advantage of providing thermic or acoustic insulation, permitting liquids to drain and eliminating the appearance of damp patches. The fact that the inventive floor is removable means that it is accessible and can be laid permanently or temporarily in different spaces, such as stands, commercial premises, etc.

Finally, the fact that mortar or chemical adhesives are not used in laying the floor tiles confers to the invention considerable ecological and sustainability characteristics, thanks to the ease of recycling and recovery of its components.

Below, in order to facilitate a better understanding of this specification and being an integral part thereof, a series of figures are attached in which, on an illustrative rather than limiting basis, the most characteristic details of the invention have been represented.

BRIEF DESCRIPTION OF THE FIGURES

FIG. 5.—Shows a partial view in cross-section of an example in which the floor tiles are joined head on.

DESCRIPTION OF THE PREFERRED EMBODIMENT

Figure 1:
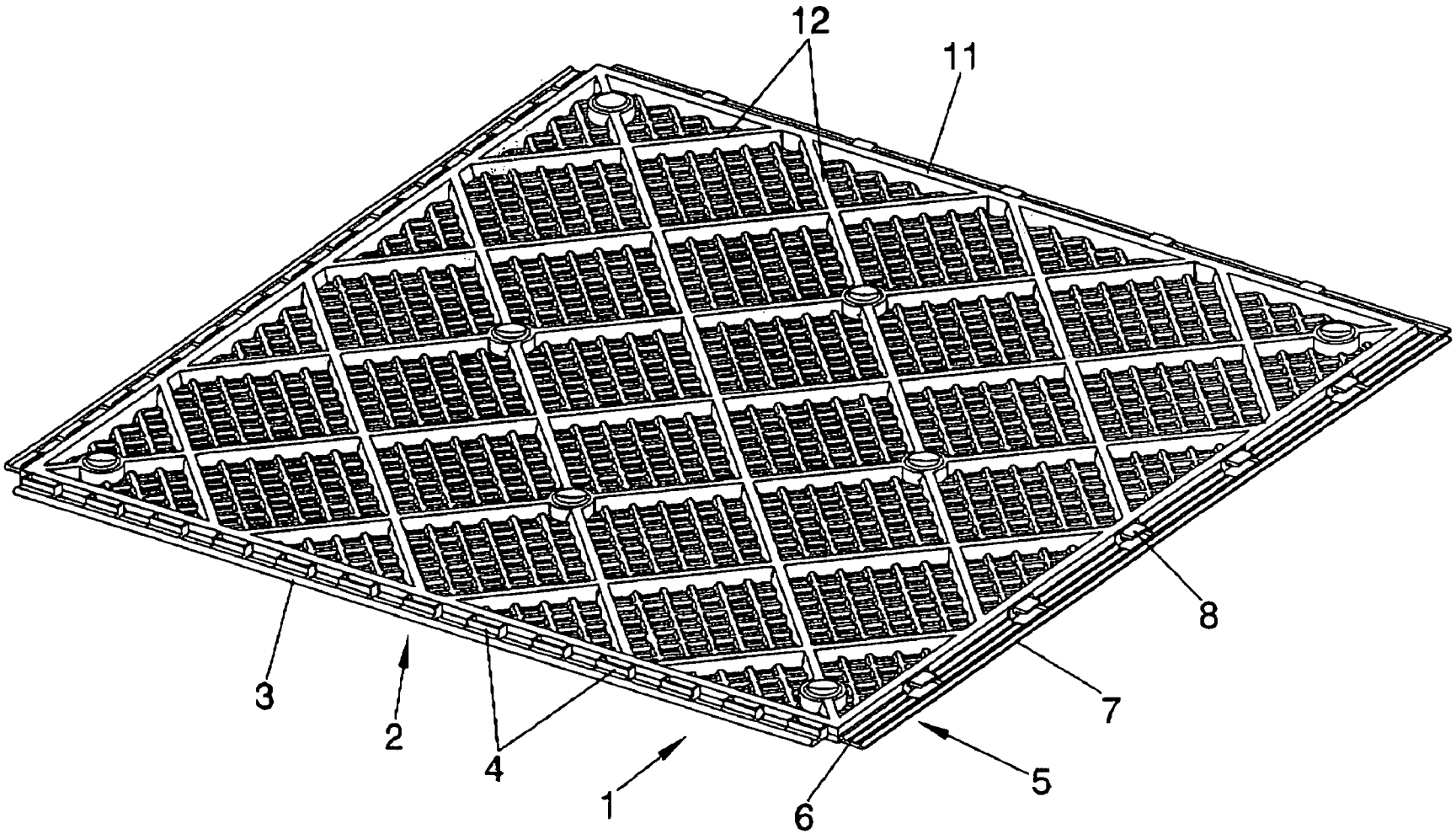
FIG. 1.—Shows a perspective view of the lower face of the grille constituting the support piece.
Figure 2:
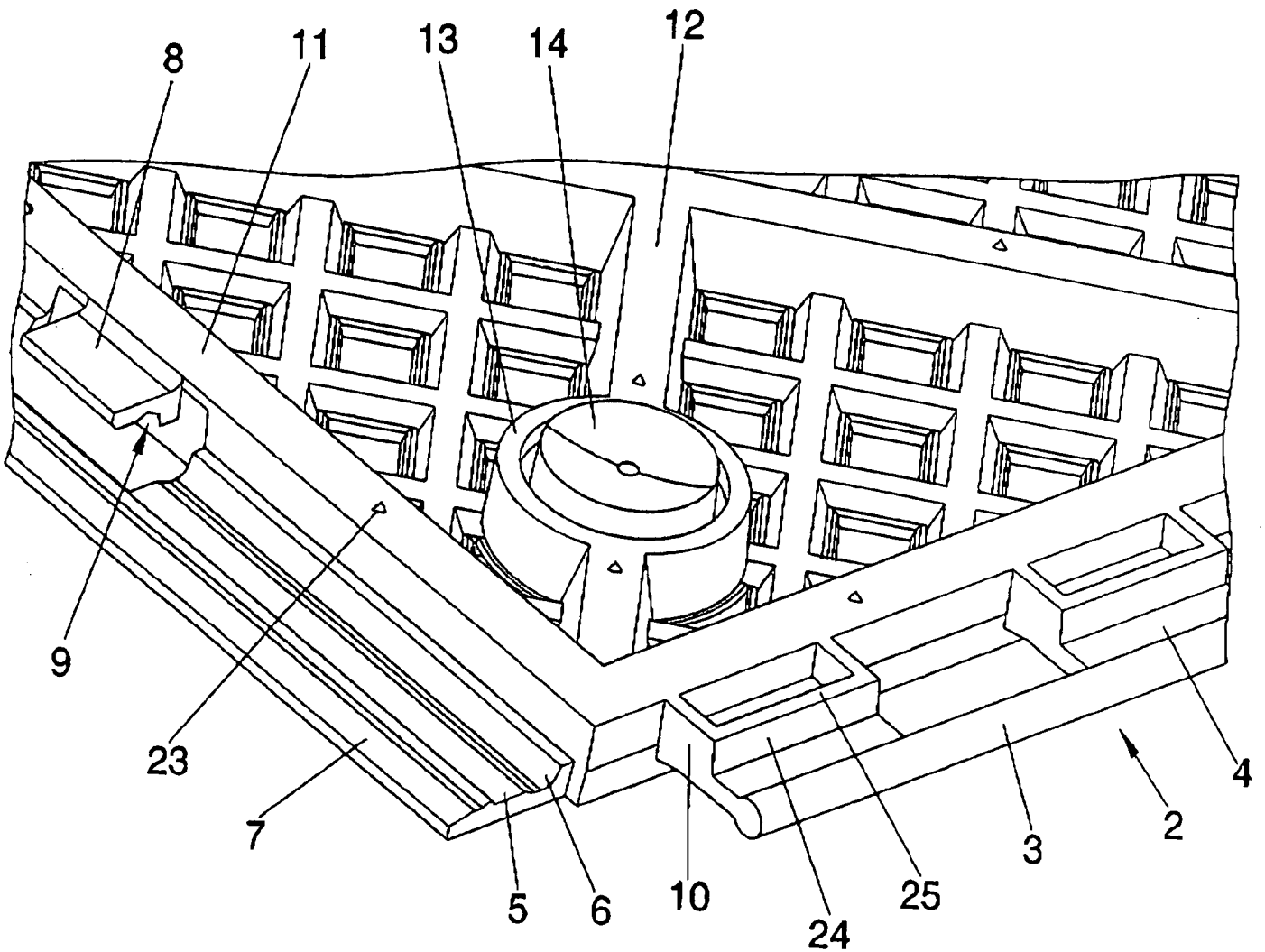
FIG. 2.—Shows a perspective view of the lower face of a detail of the grille of FIG. 1 where the configuration of the removable stoppers, along with the means constituting the joint for the different grilles can be seen.
Figure 3:
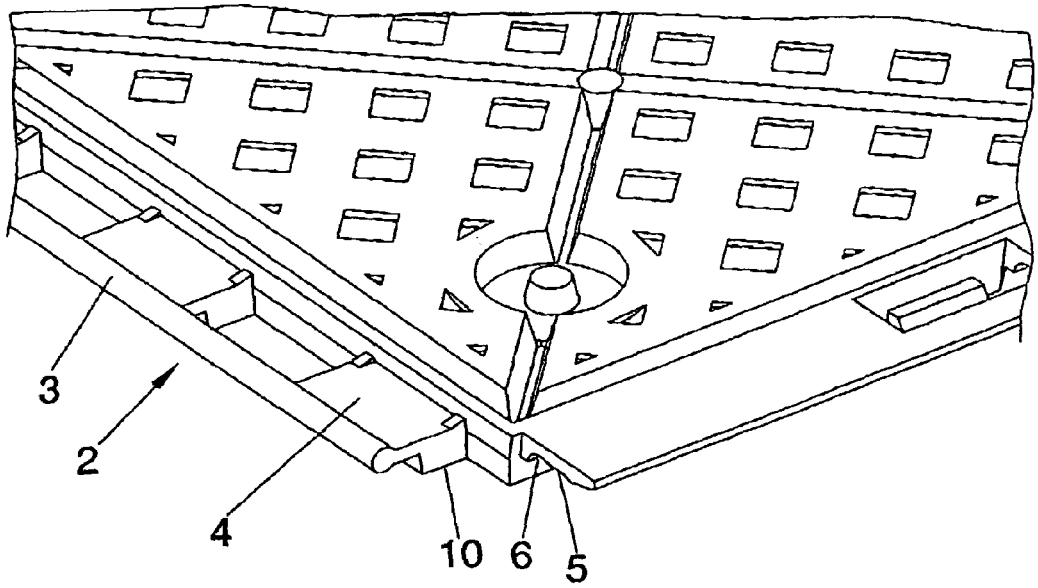
FIG. 3.—Shows a partial perspective view of the upper face of the grille.

Given below is a description of the invention based on the figures previously commented.

The invention comprises a support 1 consisting of a grille 1 with two abuting sides including some middle longitudinal extensions 2 which are defined by a set of equidistant sections 4 which attach a thickening 3, defined by a curved shape body, to the middle zone of the sides of the grilles 1.

Provided on the other two abuting sides of the grilles 1 are separate upper longitudinal extensions 5 and separate lower extensions which are determined by flanges 8 equidistant to each other.

The upper longitudinal extensions 8 are endowed in their rear part of the lower face with a curved recess 6 which faces a curved recess 9 provided in the lower face and rear part of the flanges 8.

Moreover, the front edge of the lower face of the upper longitudinal extensions 5 includes a longitudinal bevel 7 which projects with respect to the flanges 8, for which these flanges have a width narrower than the upper longitudinal extensions 5; all this in order to facilitate the engagement of the middle longitudinal extensions 2 in the housing defined by the curved recesses 6 and 9 which are respectively provided in the upper longitudinal extension 5 and the flanges 8.

In order to carry out the joint of the grilles to each other, the thickening 3 is located on the bevel 7 and it is then pressed until said thickening 3 is introduced into the curved recesses 6 and 9. This operation is favoured by the arrangement of the flanges 8 which, due to being short in length and width, facilitate the introduction of the thickening into the curved recesses 6 and 9 under pressure.

Stuck on top of each grille 1 there is a floor tile 15 as it will be described further below, in such a way that when the different grilles are joined together the surfaces become covered, quickly and simply, by the floor tiles.

In order to carry out the support for the grilles over the surface to cover, provision is made for their lower face to include a set of lateral 11 and diagonal 12 ribs for reinforcement and support over the surface to cover.

In another embodiment of the invention, provision is made for the lower face of the grille to include some retention fittings 13 consisting in removable stoppers 14 which project slightly with respect to the lateral 11 and diagonal 12 ribs in order to produce the support of the grilles. These removable stoppers 14 are made of rubber or any other flexible material.

The invention foresee the possibility (not represented in the figures) of locating a grille on a substrate prepared for this purpose which allows the reception of the grilles.

Another possibility is that very often it is necessary to pass cables or pipes underneath the floor, in such case the lower faces of the grilles contain partitions 17 which raise up the grille at a sufficient height for allowing the passage of cables and pipes beneath the lower part of that grille.

For the case in which it is required to allow the passage of pipes and cables beneath the grille, the invention foresee the incorporation into the lower face thereof of some elevation projections 18 in which the removable stoppers 14 are inserted, constituting said removable stoppers the support points for the grille.

As already mentioned above, the floor tiles 15 are glued on to the grilles 1, but it can be highlighted that this joint is carried out selectively, so that the floor tiles remain separated from each other, defining a joint between them which is filled in the conventional way, or in order to get the floor tiles 15 to be joined head on, according to their manufacturing dimension.

Figure 4:
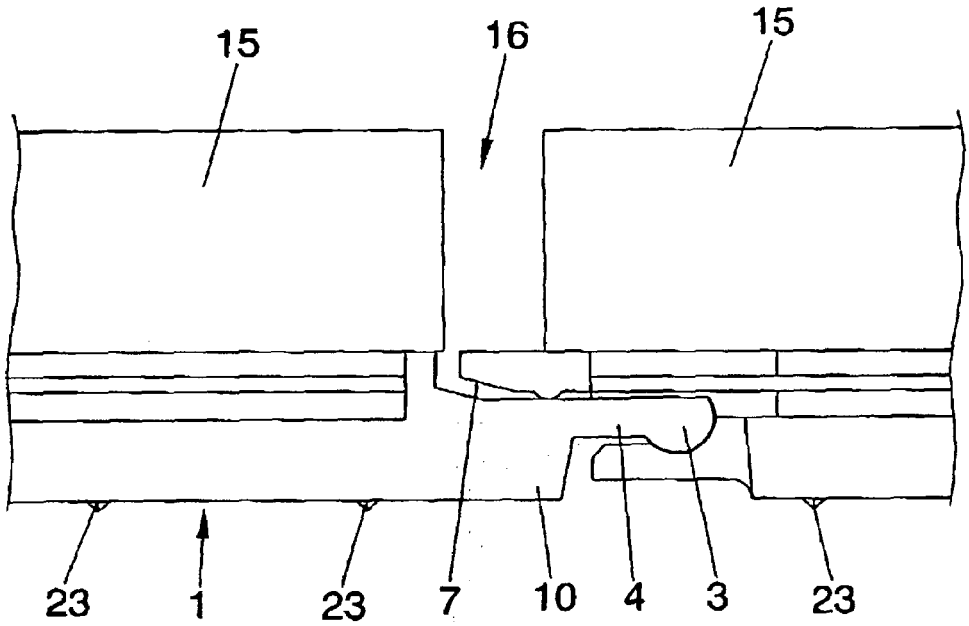
FIG. 4.—Shows a partial view in cross-section of an example of union between two grilles for the case in which the floor tiles are laid separated by a distance defining a joint.

So, in the example of embodiment of FIG. 4, the floor tiles have a dimension such that when the joint between the grilles takes place, a gap 16 remains between then, defining said joint.

This is achieved when the two smaller abuting sides 19 and 20 of said floor tiles are coplanar with the corresponding smaller sides of the support 1, the other two opposite sides 21 and 22 of the floor tiles 15 being those that are out of phase with respect to their corresponding sides of the support, in order to modify the width of the joint 16, or so that the floor tiles remain joined head on depending on the manufacturing dimension of them.

Figure 5:
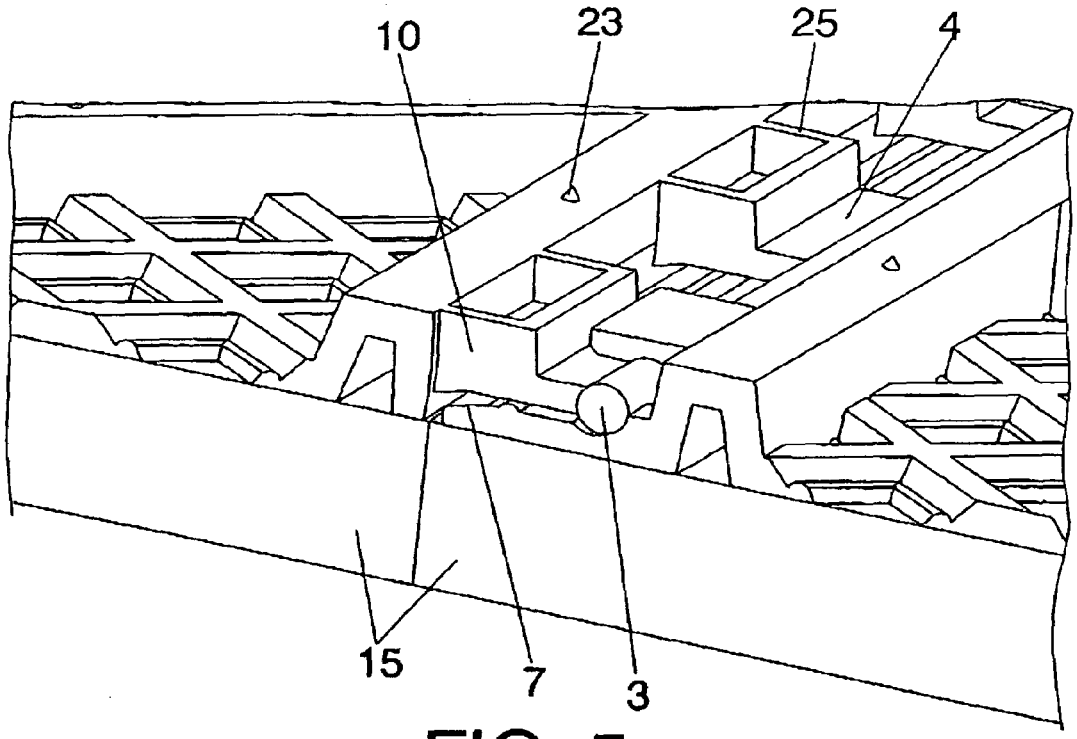
Figure 6:
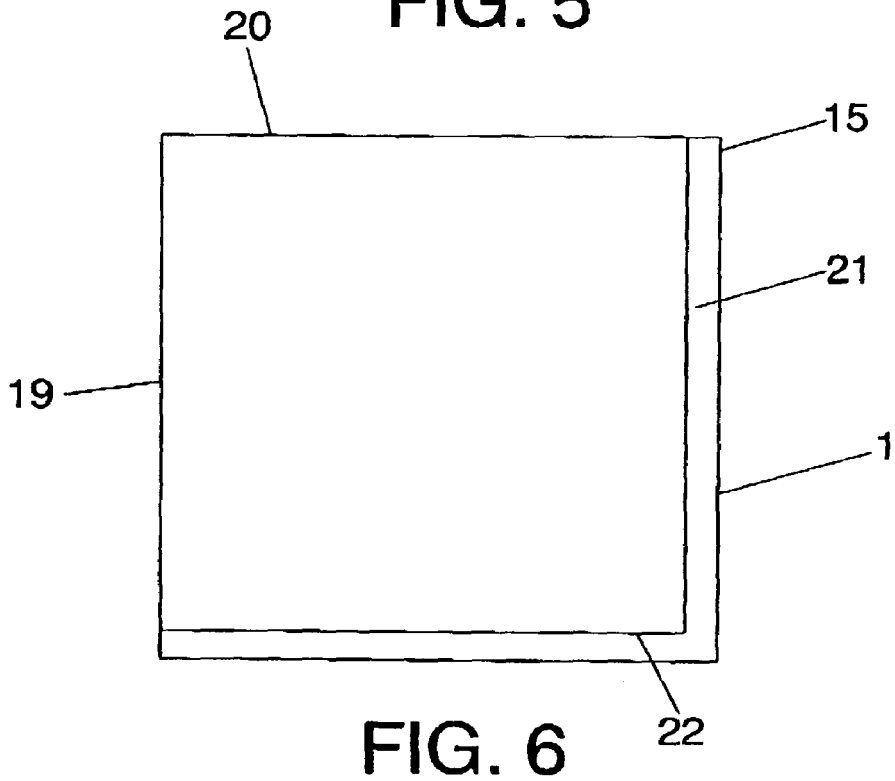
FIG. 6.—Shows a schematic view of a possible embodiment of a floor tile mounted on the grille. The phase difference between two of the abuting sides of the floor tile with respect to those of the grille determines whether or not the floor tiles form a joint after being laid.
Figure 7:
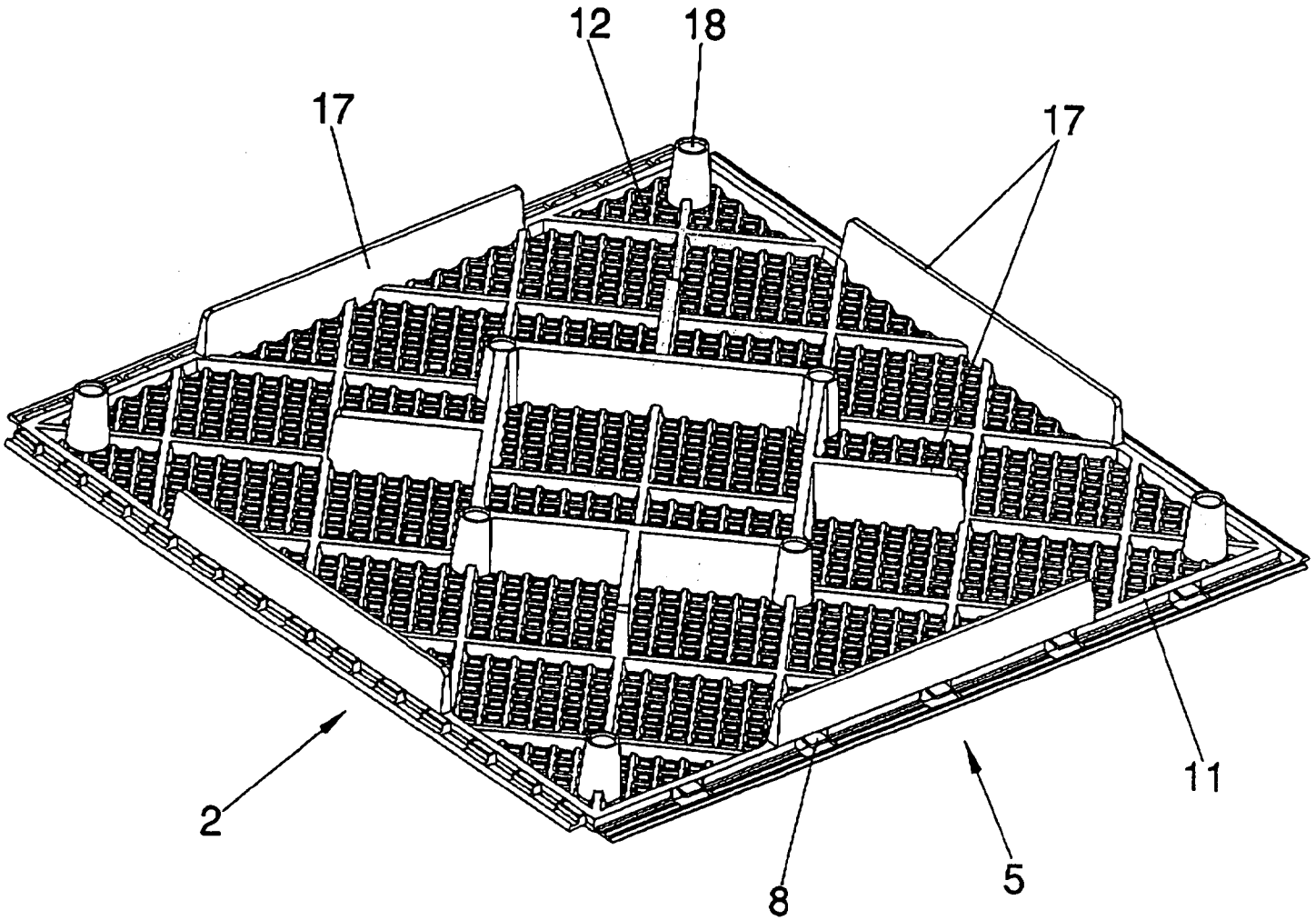
FIG. 7.—Shows an example of embodiment of the inventive grille for the case in which cables or pipes are required to pass underneath them.

In this way, provision is made so that the joint can have a different width, and it can even disappear, as shown in FIGS. 5 and 6, and, depending on their size, the floor tiles 15 can be joined head on or, on the contrary, they can form a joint 16 of selectable width at all times depending on the size of the floor tiles 15.

Figure 9:
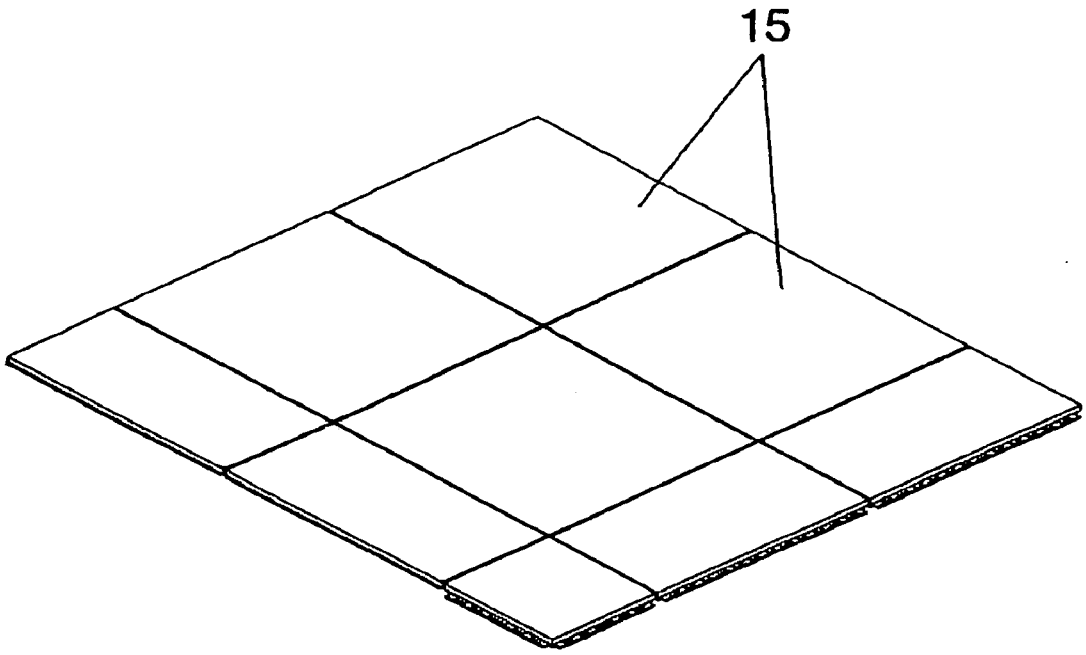
FIG. 9.—Shows a schematic view of a possible embodiment in which the floor tiles and grilles adopt different sizes in order to adapt themselves to different surfaces, and/or to define different decorative motifs.

FIG. 9 shows different sizes of floor tile and grilles for being adapted to the surface to cover, and/or for producing different decorative motifs.

Figure 8:
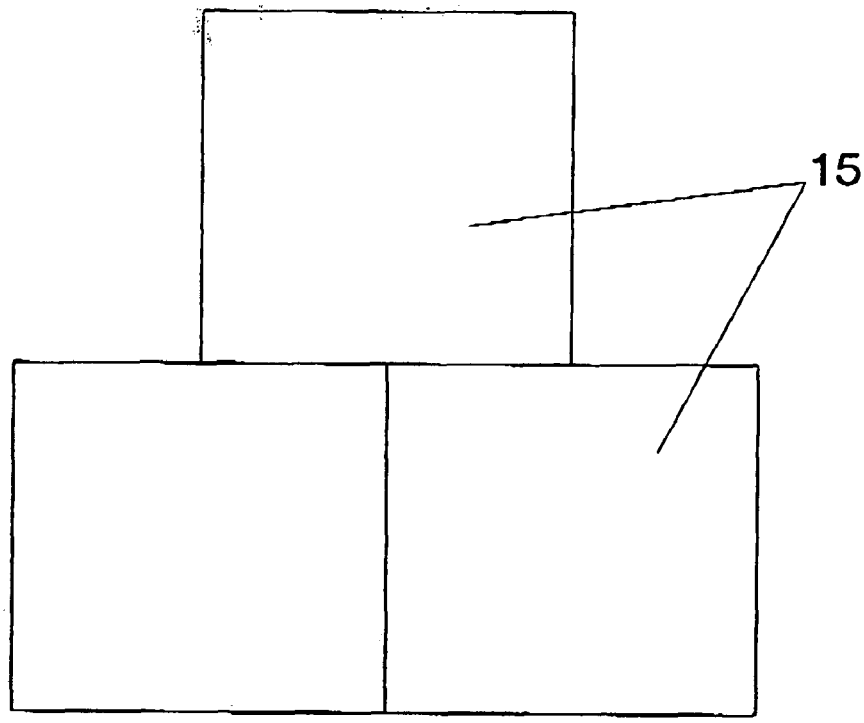
FIG. 8.—Shows a schematic view of a possible embodiment in which the floor tiles are laid alternatively out of phase to each other, for which the grilles are laid adopting this phase difference. This example could adopt any other configuration according to the desired decorative motif, since the grilles can be moved around with respect to one another.

The configuration described permits the grilles to be laid out of phase with respect to the others in the longitudinal and/or transverse direction, with which the floor tiles are equally out of phase between each other, as shown, for example, in FIG. 8.

The ribs 11, 12 can have projections 23 which hinder the movement of the pieces in the event of their being laid on a flexible substrate.

Finally, it can be highlighted that the set of equidistant sections (4) show lower support extensions (10) with the aim of preventing them from bending once the floor has been laid. Said extensions define a support plane (25) that is coplanar with the rest of the surface for seating the grille (1).

The invention claimed is:

1. A removable floor, comprising:

a plurality of support pieces, each of the support pieces having a floor tile glued thereon, each support piece being arranged to be secured to other support pieces, and each support piece comprising separate upper longitudinal extensions and separate lower extensions arranged on two abutting lateral faces of the support piece so as to define a housing, and separate middle longitudinal extensions arranged on two other lateral faces of the support piece, the middle longitudinal extensions being insertable into the housing so as to define a tongue and groove joint, wherein each middle longitudinal extension includes a set of equidistant sections which are joined to a thickening defined by a curved shape body and a middle zone of sides of the support piece, wherein each lower extension includes at least two flanges having a width less than that of the upper longitudinal extensions, each flange comprising a curved recess, wherein a lower face of each upper longitudinal extension includes a longitudinal bevel at a front end thereof in order to facilitate introduction of the middle extensions into the housing, and a longitudinal curved recess arranged at a rear part thereof so as to face the curved recesses of the flanges, and wherein each floor tile is to be arranged at a position in which adjacent floor tiles contact each other, or at position in which adjacent floor tiles are separated from each other by a gap by way of a joint, a width of the gap being defined by a dimension of the floor tiles.

2. A removable floor according to claim 1, wherein each floor tile is glued on its support such that two abutting sides of the floor tile are coplanar with corresponding abutting sides of the support, and such that two other abutting sides of the floor tile are out of phase by a variable distance with respect to two other corresponding abutting sides of the support, so as to join adjacent floor tiles so as to contact each other, or so as to modify the width of the gap.

3. A removable floor according to claim 2, wherein the at least two flanges of each lower extension are equidistant from each other.

4. A removable floor according to claim 2, wherein each support piece is a grille.

5. A removable floor according to claim 1, wherein a lower face of each support piece comprises a set of retention fittings including removable support stoppers for supporting the support piece on a surface to be covered by the removable floor.

6. A removable floor according to claim 5, wherein the fittings are arranged to secure the support piece to the surface to be covered.

7. A removable floor according to claim 6, wherein the at least two flanges of each lower extension are equidistant from each other.

8. A removable floor according to claim 6, wherein each support piece is a grille.

9. A removable floor according to claim 5, wherein the retention fittings comprise elevation projections into which the removable stoppers are fitted so as to elevate the support piece relative to the surface to be covered and allow pipes and cables to pass beneath the support piece.

10. A removable floor according to claim 9, wherein the at least two flanges of each lower extension are equidistant from each other.

11. A removable floor according to claim 9, wherein each support piece is a grille.

12. A removable floor according to claim 5, wherein the lower face of each support piece includes at least one of lateral ribs and diagonal ribs for selective support of the support piece on the surface to be covered.

13. A removable floor according to claim 5, wherein the at least two flanges of each lower extension are equidistant from each other.

14. A removable floor according to claim 5, wherein each support piece is a grille.

15. A removable floor according to claim 1, wherein a lower face of each support piece includes at least one of lateral ribs and diagonal ribs for selective support of the support piece on a surface on which the support piece is to be arranged.

16. A removable floor according to claim 15, wherein the ribs include projections for preventing movement of the support pieces.

17. A removable floor according to claim 16, wherein the lower face of each support piece includes elevation partitions arranged to elevate the support piece relative to the surface on which the support piece is to be arranged and allow pipes and cables to pass beneath the support piece.

18. A removable floor according to claim 16, wherein the at least two flanges of each lower extension are equidistant from each other.

19. A removable floor according to claim 16, wherein each support piece is a grille.

20. A removable floor according to claim 15, wherein the at least two flanges of each lower extension are equidistant from each other.

21. A removable floor according to claim 15, wherein each support piece is a grille.

22. A removable floor according to claim 1, wherein a lower face of each support piece includes elevation partitions arranged to elevate the support piece relative to a surface on which the support piece is to be arranged and allow pipes and cables to pass beneath the support piece.

23. A removable floor according to claim 22, wherein the at least two flanges of each lower extension are equidistant from each other.

24. A removable floor according to claim 22, wherein each support piece is a grille.

25. A removable floor according to claim 1, wherein the at least two flanges of each lower extension are equidistant from each other.

26. A removable floor according to claim 25, wherein each support piece is a grille.

27. A removable floor according to claim 1, wherein each support piece is a grille.

28. A removable floor according to claim 1, wherein the set of equidistant sections include lower support extensions.

* * * * *